US005444981A

United States Patent [19]

Kakovitch

[11] Patent Number: 5,444,981

[45] Date of Patent: * Aug. 29, 1995

[54] METHOD AND APPARATUS FOR INCREASING EFFICIENCY AND PRODUCTIVITY IN A POWER GENERATION CYCLE

[75] Inventor: Thomas Kakovitch, Herndon, Va.

[73] Assignee: Millennium Rankine Technologies, Inc., Reston, Va.

[ * ] Notice: The portion of the term of this patent subsequent to Oct. 26, 2010 has been disclaimed.

[21] Appl. No.: 140,315

[22] Filed: Oct. 22, 1993

Related U.S. Application Data

[63] Continuation-in-part of Ser. No. 929,433, Aug. 14, 1992, Pat. No. 5,255,519.

[51] Int. Cl.[6] ..... F01K 21/04

[52] U.S. Cl. ..... 60/649; 60/671; 60/674

[58] Field of Search ..... 60/649, 671, 674

[56] References Cited

U.S. PATENT DOCUMENTS

| | | | |
|---|---|---|---|
| 709,115 | 9/1902 | Rosenthal . | |
| 848,027 | 3/1907 | Goodspeed et al. . | |
| 3,861,151 | 1/1975 | Hosokawa | 60/649 |
| 4,106,294 | 8/1978 | Czaja | 60/649 |
| 4,196,594 | 4/1980 | Abom | 60/649 |
| 4,387,576 | 6/1983 | Bissell | 60/649 |
| 4,422,297 | 12/1983 | Rojey | 60/651 |
| 4,439,988 | 4/1984 | Minardi et al. | 60/649 |
| 4,729,226 | 3/1988 | Rosado | 60/649 |
| 4,779,424 | 10/1988 | Sumitomo et al. | 60/649 |
| 4,838,027 | 6/1989 | Rosado | 60/671 |
| 4,876,855 | 10/1989 | Yoger et al. | 60/651 |
| 5,089,048 | 2/1992 | Knoblauch et al. | 55/25 |
| 5,255,519 | 10/1993 | Kakovitch | 60/649 |

*Primary Examiner*—Ira S. Lazarus
*Assistant Examiner*—L. Heyman
*Attorney, Agent, or Firm*—Dennison, Meserole, Pollack & Scheiner

[57] ABSTRACT

A method and apparatus for converting heat energy to mechanical energy with greater efficiency. According to the method, heat energy is applied to a working fluid in a reservoir sufficient to convert the working fluid to a vapor and the working fluid is passed in vapor form to means such as a generator for converting the energy therein to mechanical work. The working fluid is then recycled to the reservoir. In order to increase the efficiency of this process, a gas having a molecular weight no greater than the approximate molecular weight of the working fluid is added to the working fluid in the reservoir, separated from the working fluid downstream from the reservoir, compressed and returned to the reservoir.

20 Claims, 11 Drawing Sheets

The Ideal Regenerative Cycle

The Ideal Regenerative Cycle

The Air-Standard Atkinson Cycle

The Air-Standard Atkinson Cycle

Rankine Cycle

Rankine Cycle

E Ricssion Cycle

E Ricssion Cycle

Diesel Cycle

Diesel Cycle

METHOD AND APPARATUS FOR INCREASING EFFICIENCY AND PRODUCTIVITY IN A POWER GENERATION CYCLE

This application is a continuation-in-part of application Ser. No. 07/929,433, filed Aug. 14, 1992, incorporated herein by reference.

BACKGROUND OF THE INVENTION

The invention relates to the field of converting heat energy to mechanical energy utilizing a working fluid, particularly for, but not necessarily limited to generating electricity.

In order to perform useful work, energy must be changed in form, i.e., from potential to kinetic, heat to mechanical, mechanical to electrical, electrical to mechanical, etc. The experimentally demonstrated equivalence of all forms of energy led to the generalization of the first law of thermodynamics, that energy cannot be created or destroyed, but is always conserved in one form or another. Thus, in transforming energy from one form to another, one seeks to increase the efficiency of the process to maximize the production of the desired form of energy, while minimizing energy losses in other forms.

Mechanical, electrical and kinetic energy are energy forms which can be transformed into each other with a very high degree of efficiency. This is not the case, however, for heat energy; if we try to transform heat energy at a temperature T into mechanical work, the efficiency of the process is limited to $1-T_O/T$, in which $T_O$ is the ambient temperature. This useful energy which can be transformed is called exergy, while the forms of energy which cannot be transformed into exergy are called anergy. Accordingly, the first law of thermodynamics can be restated that the sum of exergy and anergy is always constant.

Moreover, the second law of thermodynamics which states that processes proceed in a certain defined direction and not in the reverse direction, can be restated that it is impossible to transform anergy into exergy.

Thermodynamic processes may be divided into the irreversible and the reversible. In irreversible processes, the work done is zero, exergy being transformed into anergy. In reversible processes, the greatest possible work is done.

Energy conversion efforts are based upon the second law, to make the maximum use of exergy before it is transformed into anergy, a form of energy which can no longer be used. In other words, conditions must be created to maintain the reversibility of processes as long as possible.

The present invention is concerned with the conversion of heat energy to mechanical energy, particularly for the generation of electrical power, the process which presents the greatest problems with regard to efficiency. In the processes, heat is transferred to a working fluid which undergoes a series of temperature, pressure and volume variations in a reversible cycle. The ideal regenerative cycle is known as the Carnot cycle, but a number of other conventional cycles may be used, especially the Rankine cycle, but also including the Atkinson cycle, the Ericsson cycle, the Brayton cycle, the Diesel cycle and the Lenoir cycle. Utilizing any of these cycles, a working fluid in gaseous form is passed to a device for converting the energy of the working fluid to mechanical energy, which devices include turbines as well as a wide variety of other types of heat engines. In each case, as the working fluid does useful mechanical work, the volume of the fluid increases and its temperature and pressure decrease. The remainder of the cycle is concerned with increasing the temperature and pressure of the working fluid so that it may perform further useful mechanical work. FIGS. 1A–1J give P-V and T-S diagrams for a number of typical cycles.

Since the working fluid is an important part of the cycle for doing useful work, a number of processes are known in which working fluid is modified in order to increase the work that can be obtained from the process. For example, U.S. Pat. No. 4,439,988 discloses a Rankine cycle utilizing an ejector for injecting gaseous working fluid into a turbine. By utilizing the ejector to inject a light gas into the working fluid, after the working fluid has been heated and vaporized the turbine was found to extract the available energy with a smaller pressure drop than would be required with only a primary working fluid and there is a substantial drop in temperature of the working fluid, enabling operation of the turbine in a low temperature environment. The light gas which is used can be hydrogen, helium, nitrogen, air, water vapor or an organic compound having a molecular weight less than the working fluid.

U.S. Pat. No. 4,196,594 discloses the injection of a rare gas, such as argon or helium, into a gaseous working fluid such as aqueous steam used to carry out mechanical work in a heat engine. The vapor added has a lower H value than the working fluid, the H value being $C_p/C_v$, $C_p$ being specific heat at constant pressure and $C_v$ being specific heat at constant volume.

U.S. Pat. No. 4,876,855 discloses a working fluid for a Rankine cycle power plant comprising a polar compound and a non-polar compound, the polar compound having a molecular weight smaller than the molecular weight of the non-polar compound.

In considering the conversion of heat energy to mechanical energy, an extremely important thermodynamic property is enthalpy. Enthalpy is the sum of the internal energy and the product of pressure and volume, $H=U+PV$. Enthalpy per unit mass is the sum of the internal energy and the product of the pressure and specific volume, $h=u+Pv$. As pressure approaches zero, all gases approach the ideal gas and the change of the internal energy is the product of the specific heat, $C_{pO}$ and the change of temperature dT. The change of "ideal" enthalpy is the product of $C_{pO}$ and the change of temperature, $dh=C_{pO}dT$. When pressure is above zero, the change of enthalpy represents the "actual" enthalpy.

The difference between the ideal enthalpy and the actual enthalpy divided by the critical temperature of the working fluid is known as residual enthalpy.

Applicant has theorized that greater efficiency from a reversible process is feasible if one can increase the change in actual enthalpy of a system, within the range of temperature and pressure conditions as required by its previous design. This could conceivably be accomplished by methods which would result in the release of "residual" enthalpy, in effect, slowing down the loss of exergy in the system.

Another extremely important property of a working fluid is the compressibility factor Z, which relates the behavior of a real gas to the behavior of an ideal gas. The behavior of an ideal gas under varying conditions of pressure (P), volume (V) and temperature (T), is given by the equation of state:

$$PV=nMRT$$

where n is the number of moles of gas, M is the molecular weight, and R is R/M, where R is a constant. This equation does not actually describe the behavior of real gases, where it has been found that:

$$PV=AnMRT \text{ or } Pv=ART$$

where Z is the compressibility factor, and v is specific volume V/nM. For an ideal gas Z equals 1, and for a real gas, the compressibility factor varies depending upon pressure and temperature. While the compressibility factors for various gases appear to be different, it has been found that compressibility factors are substantially constant when they are determined as functions of the same reduced temperature and the same reduced pressure. Reduced temperature is T/Tc, the ratio of temperature to critical temperature and reduced pressure is P/Pc, the ratio of pressure to critical pressure. The critical temperature and pressure are the temperature and pressure at which the meniscus between the liquid and gaseous phases of the substance disappears, and the substance forms a single, continuous, fluid phase.

Applicant has also theorized that a greater volumetric expansion could be obtained by modifying the compressibility factor of a working fluid.

Applicant has further theorized that substance could be found which would increase both the enthalpy and compressibility of a working fluid.

SUMMARY OF THE INVENTION

Thus, it is the object of the invention to release the residual enthalpy of a system in order to increase the efficiency of the conversion of heat energy to mechanical energy.

It is a further object of the invention to increase the expansion of a working fluid to increase the work done by the working fluid.

In order to achieve this and other objects, the invention relates to a process for converting heat energy to mechanical energy in which heat energy is applied to a working fluid in a reservoir in order to convert the fluid from liquid to vapor form, and passing the working fluid in vapor form to a means for converting the energy therein to mechanical work, with increased expansion and reduction in temperature of the working fluid, and recycling the expanded, temperature reduced working fluid to the reservoir.

Applicant has discovered that the efficiency of this process may be increased by adding a gas to the working fluid in the reservoir, the gas having a molecular weight no greater than the approximate molecular weight of the working fluid, such that the molecular weight of the working fluid and gas is not significantly greater than the approximate molecular weight of the working fluid alone. The gas is subsequently separated from the working fluid external to the reservoir and recycled to the working fluid in the reservoir.

Where the working fluid is water, the preferred gases for use in this process are hydrogen and helium. While hydrogen holds a slight advantage in terms of efficiency it is relatively disadvantageous in terms of safety in some situations, and helium is therefore preferred in practical applications.

The practical effect of adding the gas to the working fluid in the reservoir is to substantially increase the change in enthalpy, and thus the expansion which the fluid undergoes at a given heat and pressure. In view of this greater expansion, a greater amount of mechanical work can be done for a fixed amount of heat energy input, or the amount of heat energy can be reduced in order to obtain a fixed amount of work. In either case, there is a considerable increase in the efficiency of the process.

DESCRIPTION OF THE PREFERRED EMBODIMENTS

In conceiving the present invention, Applicant theorized that when a working fluid is heated in a reservoir, the change in actual enthalpy over a given temperature range is greater when a "catalytic" substance is added to the working fluid. In such cases, there would be more heat available to do work when the catalytic substances are present, and there would be an increase in pressure at any given temperature as compared with the same system without the catalyst. There could be a reduction in temperature for any given pressure as compared with the same system without the catalyst.

Applicant theorized that by combining steam with a small amount, i.e. 5% by weight, of a "catalytic" gas, the compressibility factor of the resultant gas would undergo a considerable change. The computed compressibility factors Z for combinations of steam and a number of gases are shown in FIG. 2. Over the given reduced pressure range shown in FIG. 2, which is 0.1 to greater than 10, steam alone has the smallest Z. The factor Z can be increased by adding various proportions of gases, although the change from adding the heaviest gases, Xe, Kr and Ar is relatively small. However, when one adds hydrogen or helium to the steam, the change in compressibility factor is rather dramatic. An expansion of this graph over the central part of the range is shown in FIG. 3. It can be seen from FIG. 3 that when operating in the reduced pressure range of greater than 1 but less than about 1.5, adding 5% helium to the steam increases the compressibility factor by about 50%. Adding hydrogen to the steam over this range increases the compressibility factor by approximately 80%. In effect, adding a small amount of catalytic substance to the steam results in the steam acting much closer to an ideal gas, and can provide a substantial increase in available energy output for a given temperature range.

This increase in Z can also be viewed in FIG. 4, a computer generated graph, in three dimensions, as a function of both reduced pressure and reduced temperature. By operating in excess of both the critical temperature and critical pressure, the rise in Z is even more dramatic.

In the equation below, let the subscript "a" represent properties associated with steam alone, and the subscript "w" represent properties associated with steam plus a catalytic substance, for pressure, volume, molecular mass and the constant (R). By the definition of the compressibility factor we know:

$$Z_a = \frac{Pv_a}{R_a T} \tag{2}$$

and $$Z_w = \frac{Pv_w}{R_w T} \tag{3}$$

The above equations can be combined as follows:

$$\frac{Z_w}{Z_a} = \frac{Pv_w}{R_wT\frac{Pv_a}{R_aT}} \quad (4)$$

and if P and T are the same in both systems, they will drop out of the equation which will then become:

$$\frac{Z_w}{Z_a} = \frac{R_av_w}{R_wv_a} \quad (5)$$

However, we have already shown that theoretically $Z_w$ is greater than or equal to $Z_a$, and therefore:

$$\frac{R_av_w}{R_wv_a} \leqq 1 \quad (6)$$

or $$R_av_w \leqq R_wv_a \quad (7)$$

However, we also know that:

$$R_a = \frac{\overline{R}}{M_a} \quad (8)$$

and $$R_w = \frac{\overline{R}}{M_w} \quad (9)$$

by combining these relationships with equation 7 we obtain:

$$\frac{\overline{R}}{M_a} v_w \geqq \frac{\overline{R}}{M_w} v_a \quad (10)$$

or $$\frac{M_w}{M_a} v_w \geqq v_a \quad (11)$$

We also know that:

$$v_a = \frac{V_a}{m_a} \quad (12)$$

and $$v_w = \frac{V_w}{m_w} \quad (13)$$

where $V_a$ is the standard volumetric expansion of steam and $V_w$ is the volumetric expansion of steam plus a catalytic substance. We can therefore rewrite the inequality as:

$$\frac{M_w}{M_a} \frac{V_w}{m_w} \geqq \frac{V_a}{m_a} \quad (14)$$

or $$\frac{M_w}{M_a} \cdot \frac{1}{\frac{m_w}{m_a}} V_w \geqq V_a \quad (15)$$

In the particular system being considered, steam plus 5% by weight helium, the molecular weight ($M_a$) of water is 18 and:

$$\frac{m_w}{m_a} = 1 + 0.05 = 1.05$$

By analysis, it has been determined that $M_w$ is equal to 15.4286 and therefore:

$$\frac{15.4286}{(18)(1.05)} V_w \geqq V_a \quad (17)$$

Equation 17 reduces to the following inequality:

$$V_w \div 1.225\ V_a.$$

The above equations therefore show that under a given set of conditions, the volumetric expansion of a combination of steam with helium and/or hydrogen is substantially greater than the volumetric expansion of the steam alone. By increasing the volumetric expansion of the steam under given conditions, the amount of work done by the steam can be substantially increased.

This theory was proved theoretically by making the necessary enthalpy calculations for given systems. To determine the residual enthalpy of a working fluid over a particular temperature range, it is necessary to utilize a function that ties together the ideal and actual enthalpy of the system to the generalized compressibility function. The residual enthalpy can be calculated from the following equation:

$$\frac{h^* - h}{Tc} = R\int_O^P T_r^2 \frac{dz}{dT_r} P_r \cdot d\ln P_r \quad (1)$$

where the left side of the equation represents the residual enthalpy as the pressure is increased from zero to a given pressure at a constant temperature.

Calculations were also made for enthalpy change for given variations of temperature and pressure. FIG. 5 shows the enthalpy change for steam alone, while FIG. 6 shows the enthalpy change for a combination of steam with 5% helium. These plots are superimposed in FIG. 7, and show a dramatic result. When 5% helium is added to the steam, the change of enthalpy is increased in every case by approximately 13 BTU per pound mass of water.

Consider the application of this principle to the actual generation of electrical power. A typical generating plant generates 659 megawatts of electricity utilizing 4,250,000 pounds of water per hour. By increasing the energy efficiency of the plant by 13 BTU per pound of water, a savings of approximately 55,000,000 BTU per hour can be realized.

The theory has been applied above to enthalpy release from steam, but is equally applicable to any and every working fluid which is heated to the gaseous state and which undergoes expansion and cooling to do mechanical work. Thus, adding to such a working fluid in the reservoir a gas of lower molecular weight will increase the amount of work done with the same heat input.

DESCRIPTION OF THE PREFERRED EMBODIMENTS

Figure 1A:
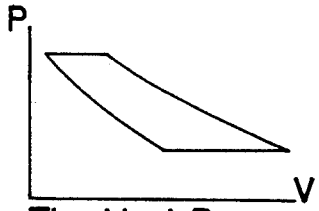
FIGS. 1A–1J show P-V and T-S graphs for a number of cycles for doing work.
Figure 1B:
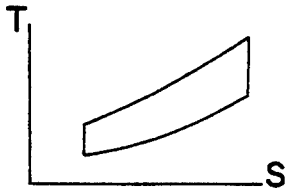
Figure 1C:
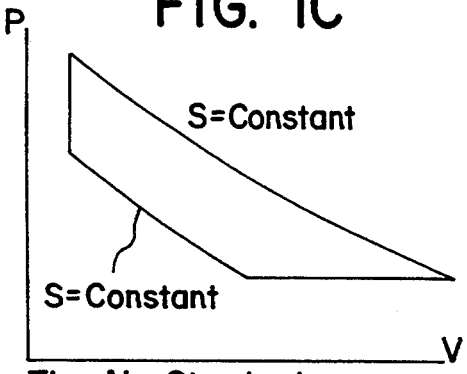
Figure 1D:
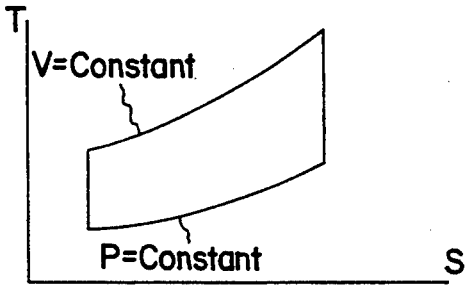
Figure 1E:
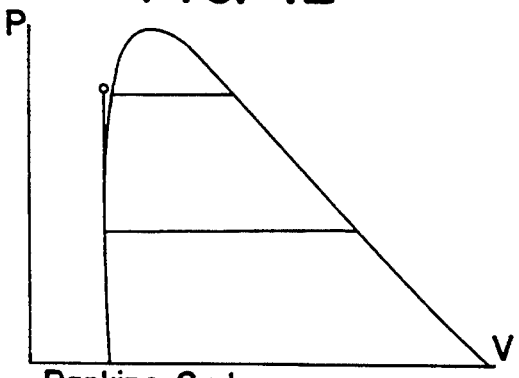
Figure 1F:
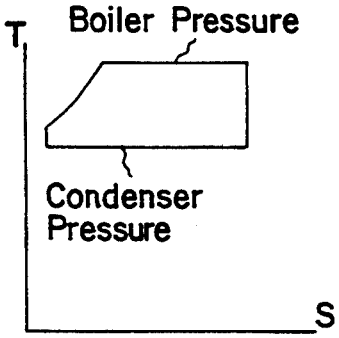
Figure 1G:
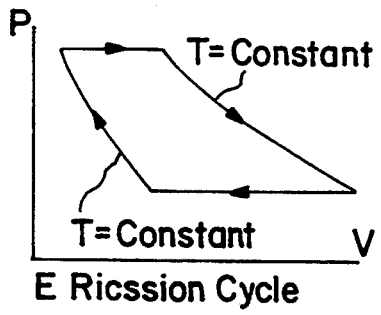
Figure 1H:
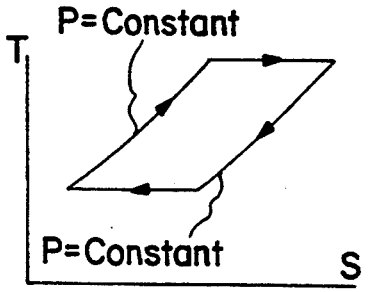
Figure 1I:
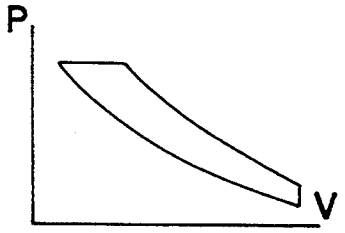
Figure 1J:
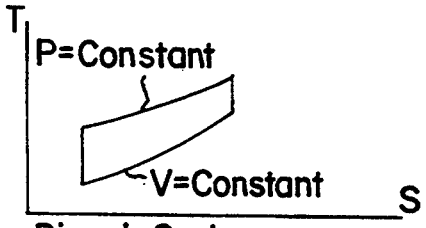
Figure 2:
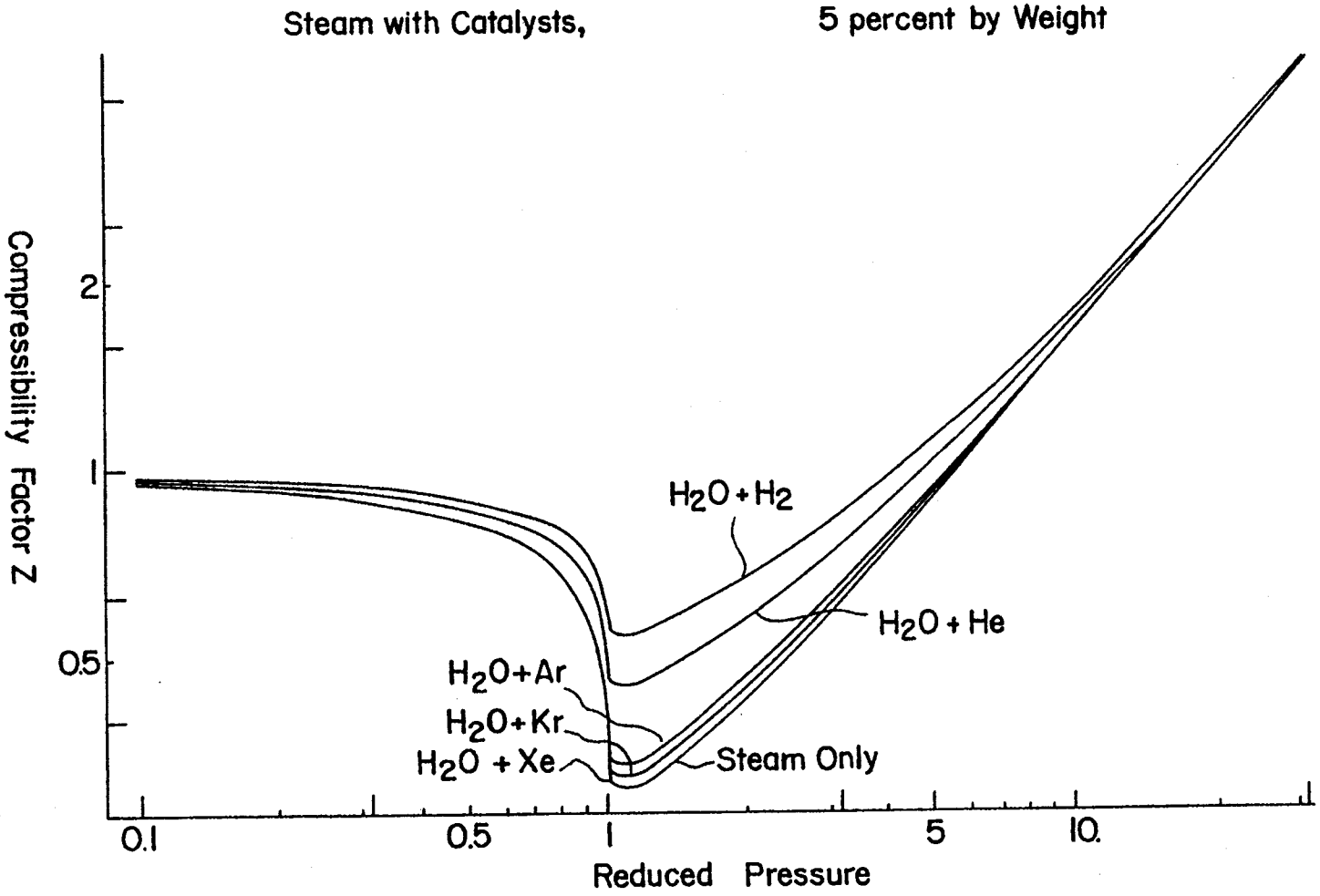
FIG. 2 is a graph of compressibility factor Z versus reduced pressure for steam alone and combinations of steam with a number of gases.
Figure 3:
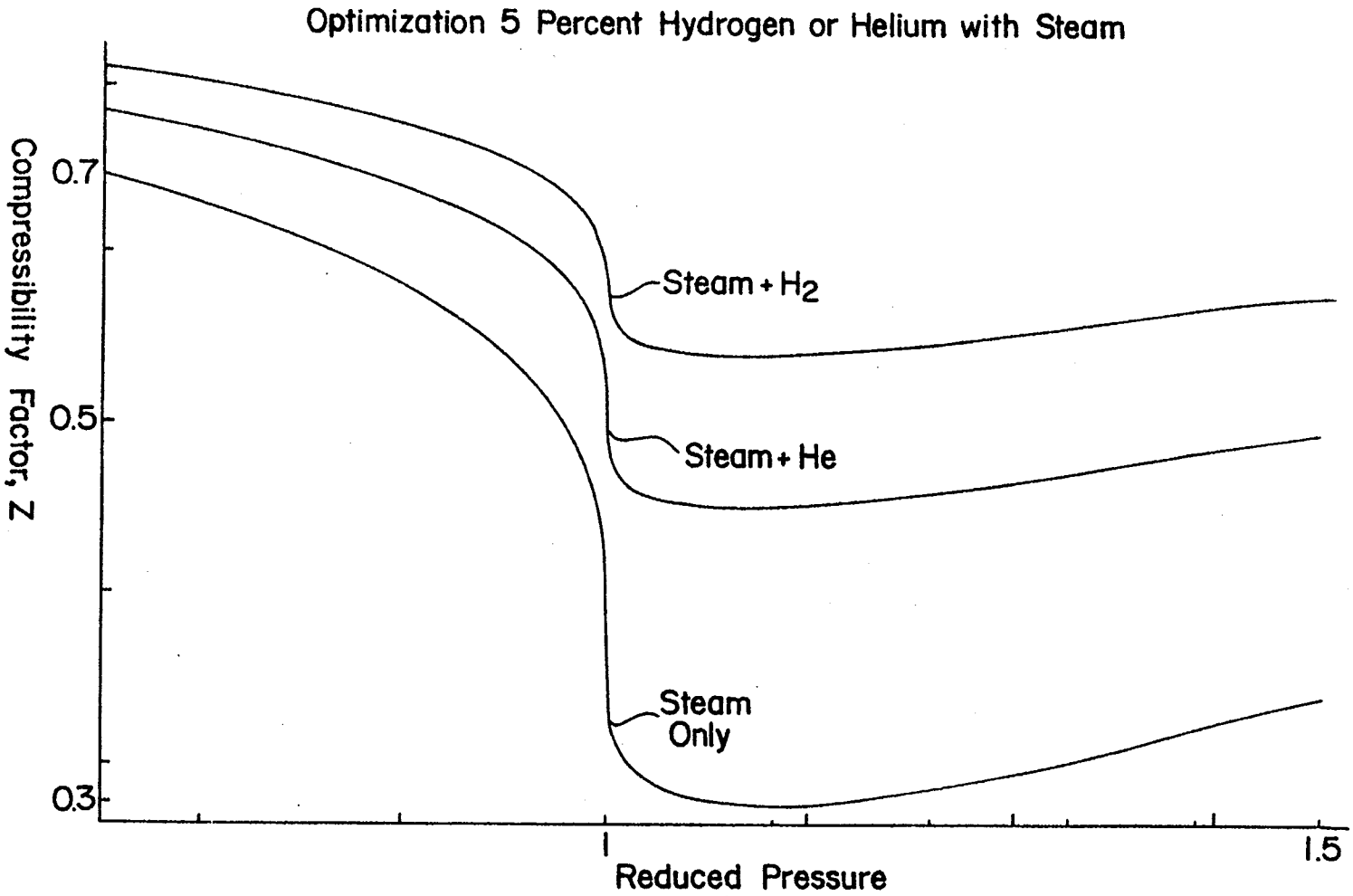
FIG. 3 is an expanded portion of the graph of FIG. 2.
Figure 4:
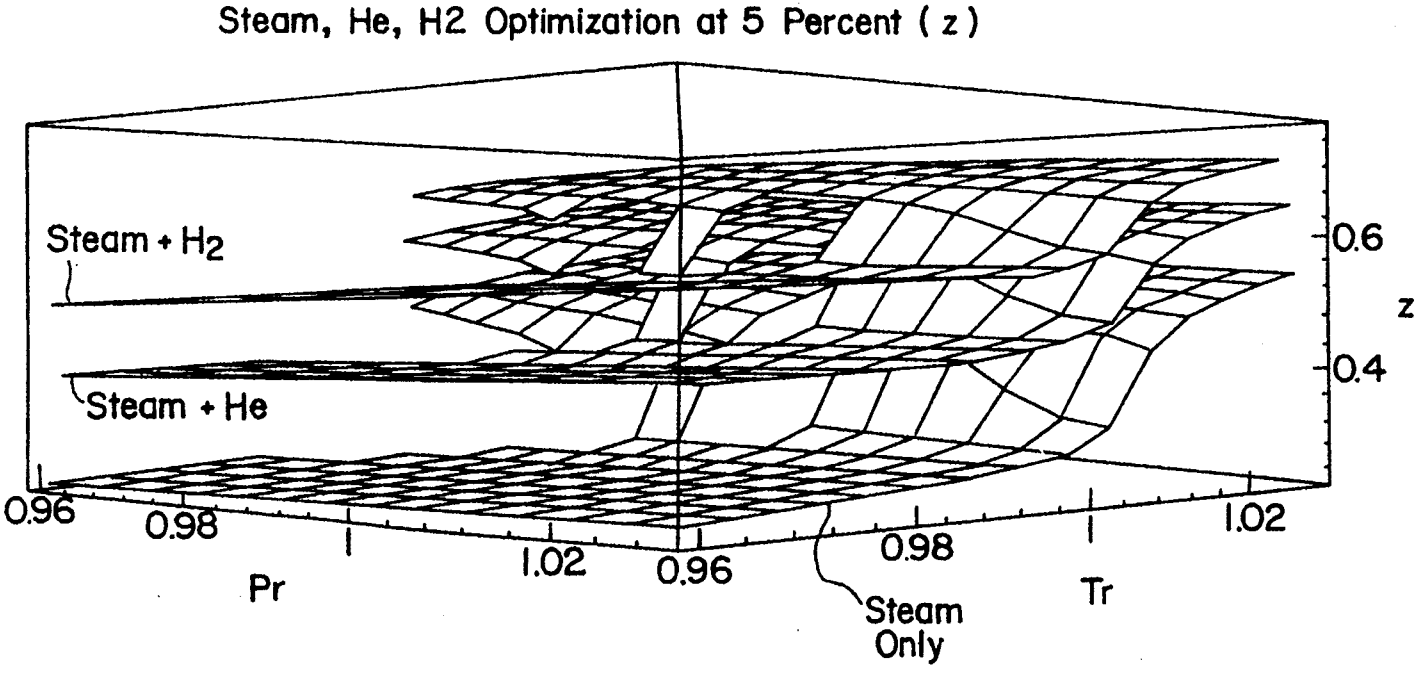
FIG. 4 is a graph of compressibility factor Z versus temperature and versus pressure for steam alone, for steam with helium and for steam with hydrogen.
Figure 5:
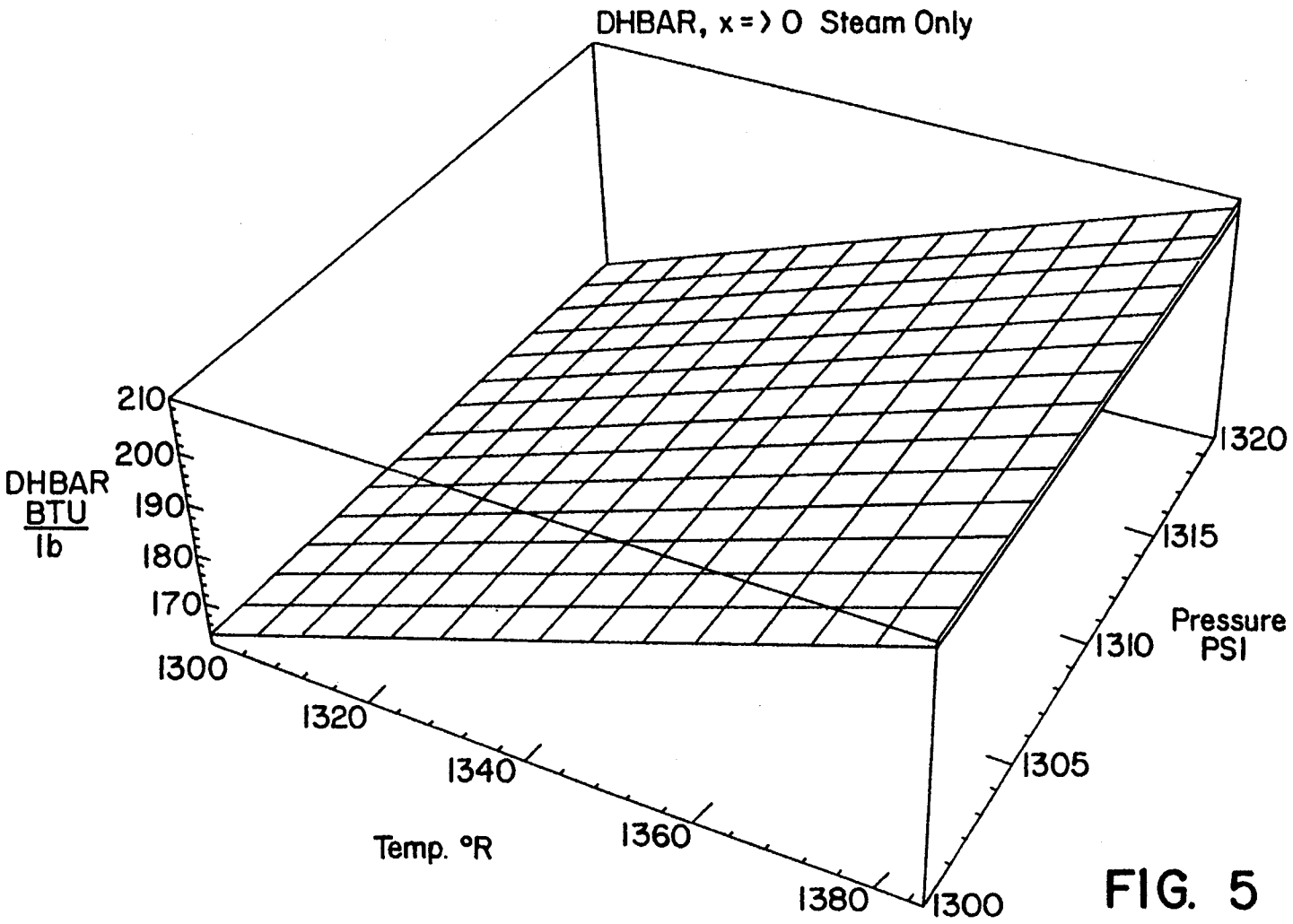
FIG. 5 is a graph of change in enthalpy versus temperature and versus pressure for steam.
Figure 6:
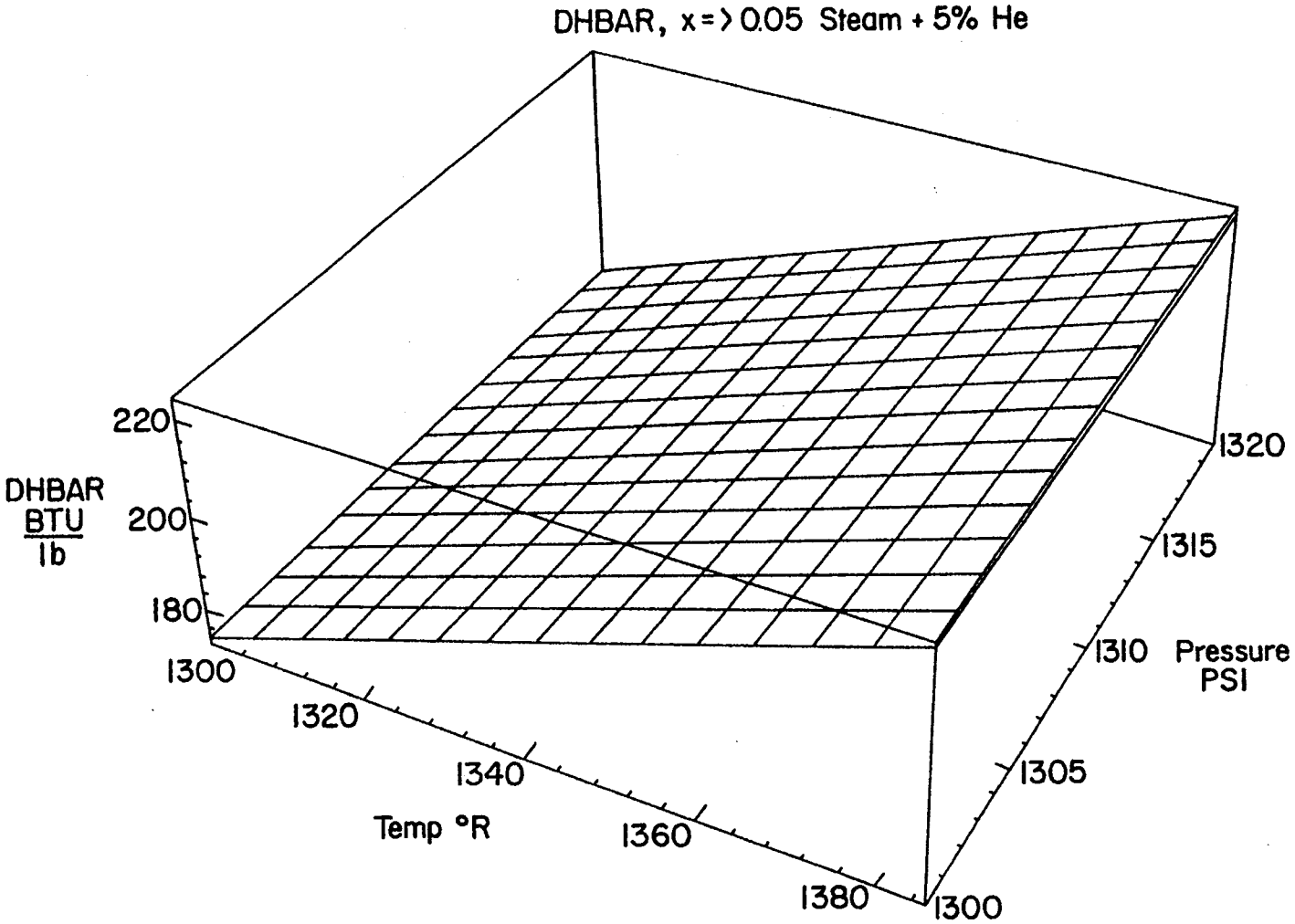
FIG. 6 is a graph of change of enthalpy versus temperature and versus pressure for steam with 5% helium.
Figure 7:
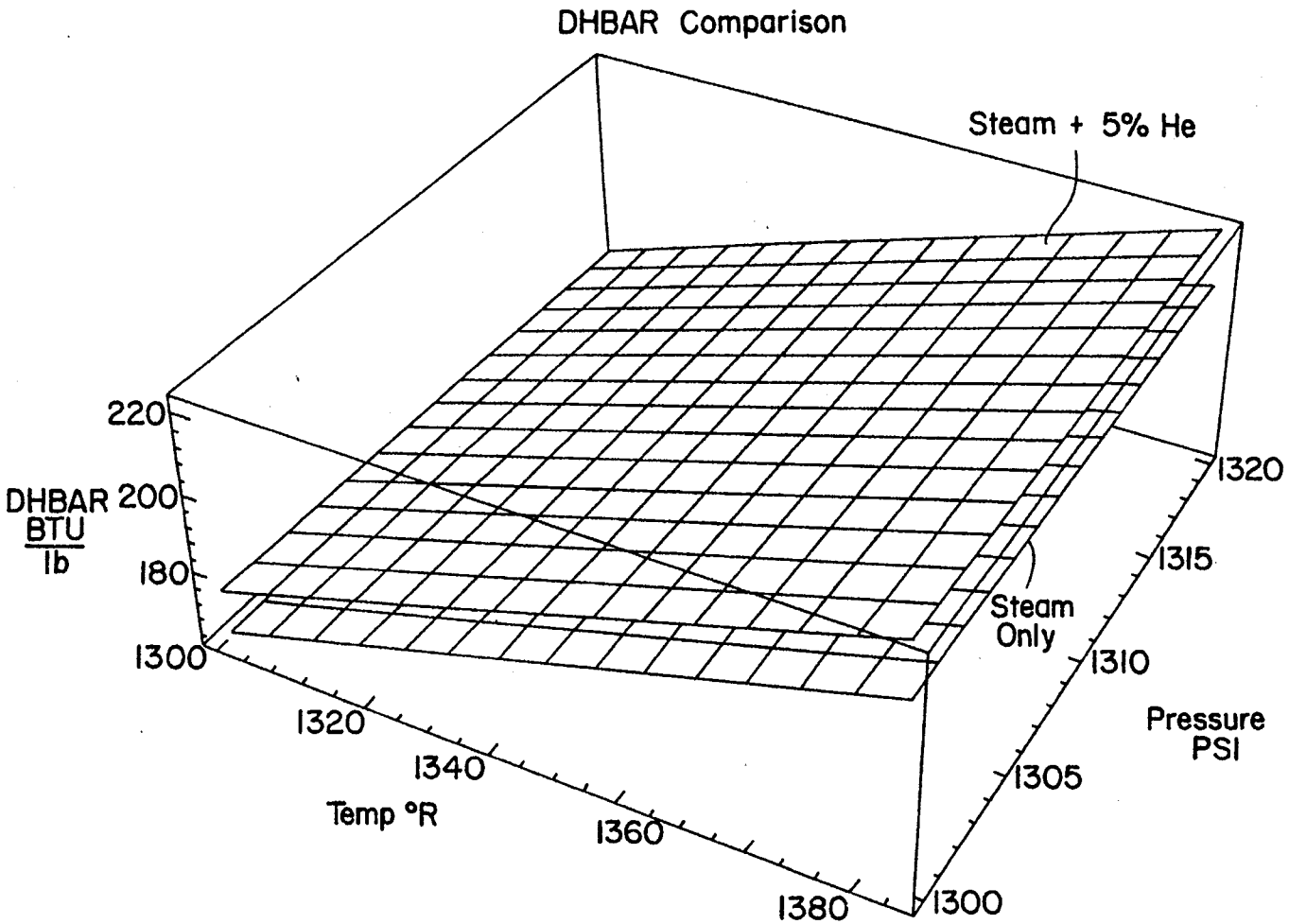
FIG. 7 is a graph of change of enthalpy versus temperature and versus pressure for both steam alone and steam with 5% helium.
Figure 8:
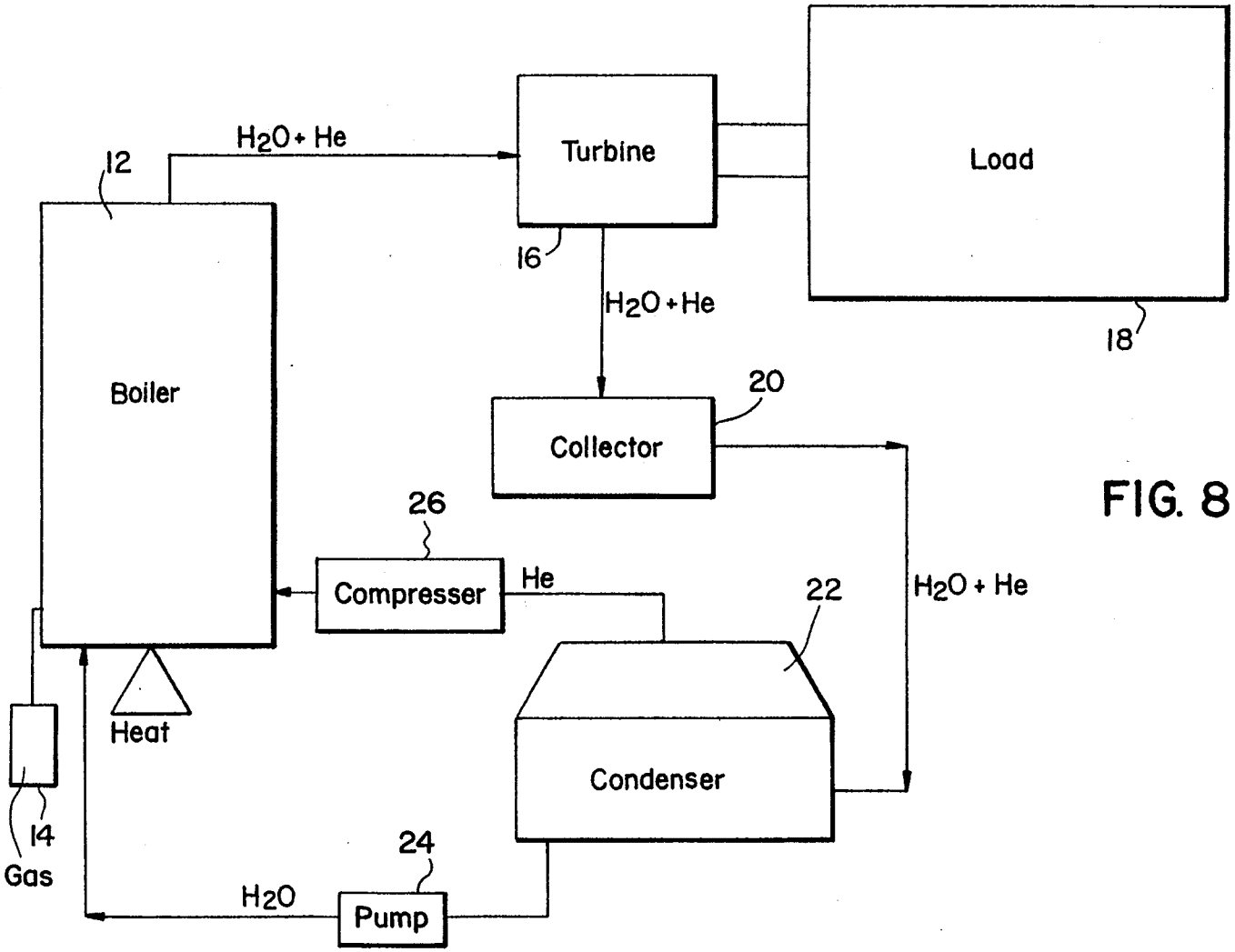
FIG. 8 is a schematic diagram of an apparatus for converting heat to mechanical energy using water as the working fluid.

An apparatus constructed as shown in FIG. 8 utilizes a boiler 12 to heat a working fluid, in this case water. A tank 14 is connected to the boiler for adding a gas to the working fluid. The output of the boiler is connected to a turbine 16 which generates electricity consumed by load 18. The working fluid which expands in turbine 16 is collected by collector 20 and condensed back to a liquid in condenser 22. Condenser 22 separates the added gas from the liquid working fluid which is then returned to the boiler, via pump 24. Where appropriate methodology is available, the gas may also be separated from the steam prior to the turbine.

Advantageously, the separated gas will be recycled to the boiler. Because the separated gas is at a lower pressure than the boiler, a compressor 26 may be interposed between the condenser and the boiler to increase the pressure of the recycled gas. This arrangement is generally suitable with boilers operating at low and moderate pressures, i.e., up to about 200 psi. Using a compressor alone to obtain He pressures above 200 psi is difficult and relatively inefficient.

Figure 9:
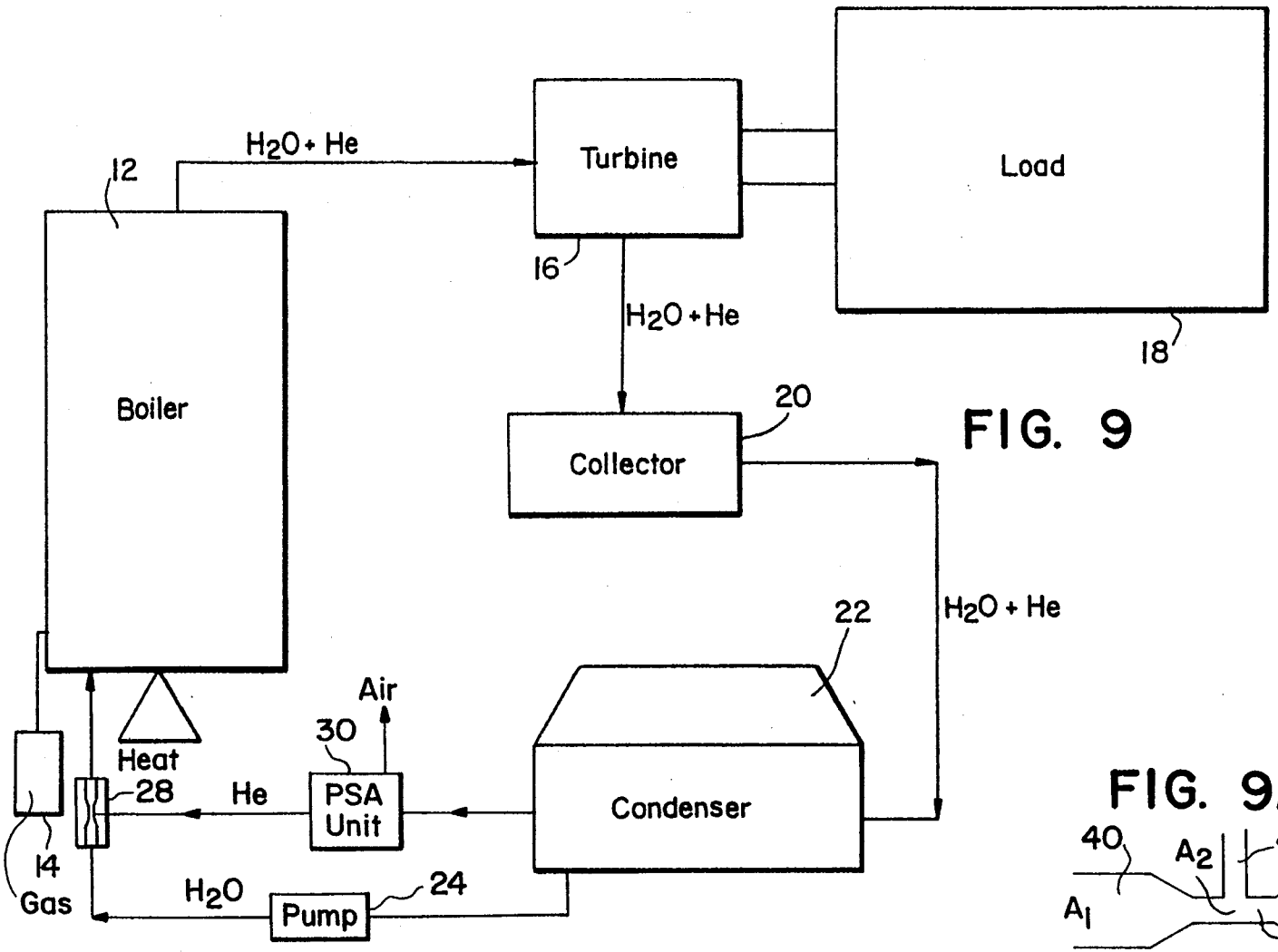
FIG. 9 shows a first modification of the apparatus of FIG. 8.
Figure 9A:
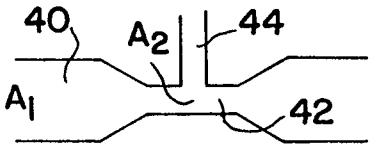
FIG. 9*a* shows in cross-section the venturi mixing device of FIG. 9.

A particularly preferred embodiment is shown in FIG. 9, in which the compressor 26 has been replaced by a venturi hydraulic compressor (VHC) 28. The VHC is a typical venturi mixing device, shown in cross-section in FIG. 9*a*, placing a restriction 42 of area $A_2$ in water line 40 of area $A_1$, creating a drop in pressure, and mixing the helium from line 44 by suction. The water, which is incompressible, compresses the helium, and increases the temperature of the water-helium mixture returned to the boiler. This is preferable to the use of a mechanical compressor in the helium return line, shown in FIG. 8, since the heat generated by the mechanical compressor is largely lost in the ambient air, and is wasted.

Also shown in FIG. 9 is the purification of the separated He by a pressure swing adsorption unit 30 interposed between the condenser and the venturi. Unit 30, which is shown schematically, is of the type known in the art for He separation and purification. One pressure swing purification process which can be used is disclosed in U.S. Pat. No. 5,089,048, which is hereby incorporated by reference. Apparatus for practicing this process is sold by Nitrotec Engineering Co. of Linthicum, Md. The process utilizes wide pore carbon molecular sieves, and separates air from the helium.

Figure 10:
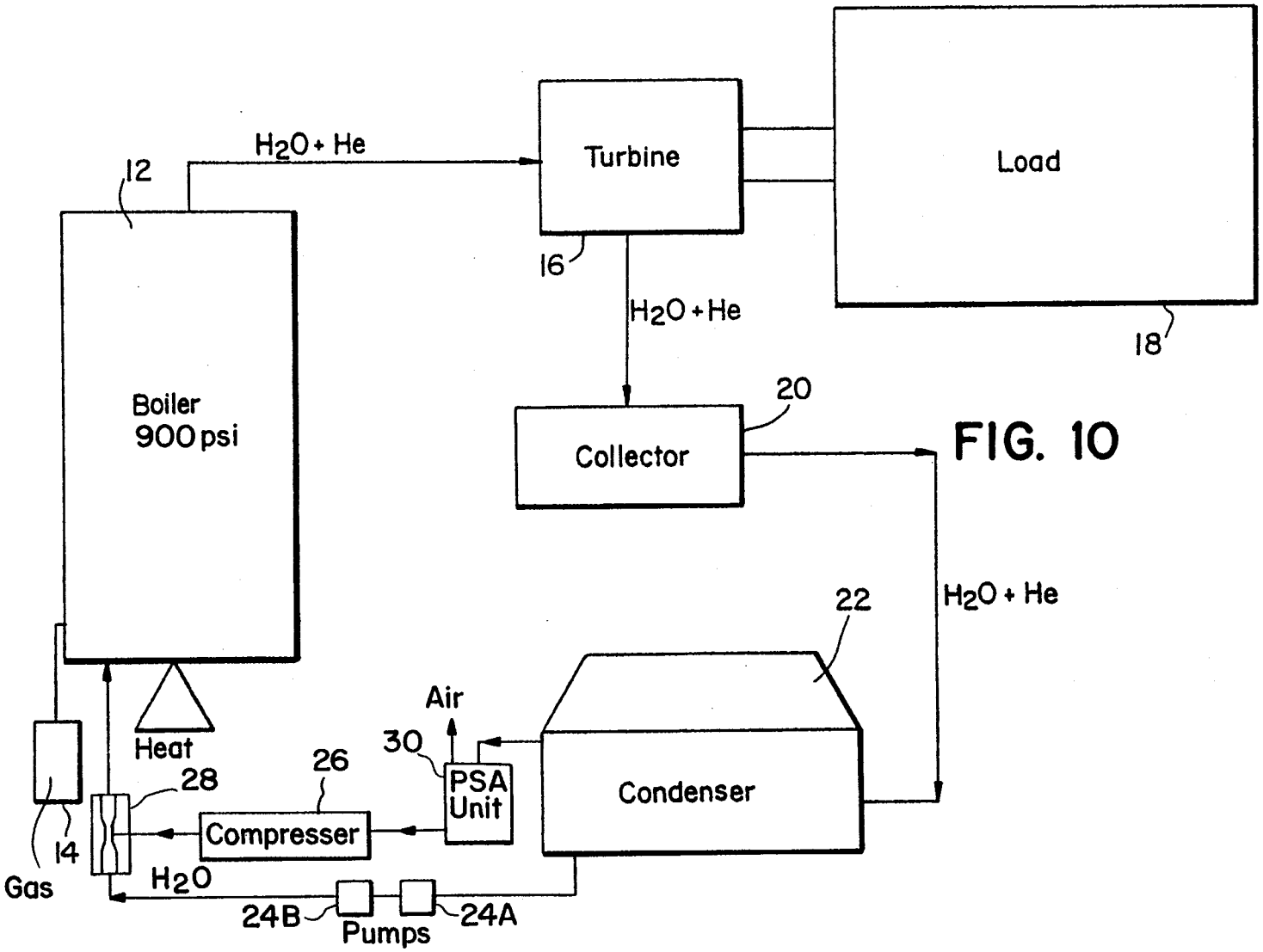
FIG. 10 shows a second modification of the apparatus of FIG. 8.

With very high boiler pressures, the arrangement shown in FIG. 10 may be used. In FIG. 10, the boiler operates at 900 psi, and both a compressor 26 and a venturi mixing device 28 are used. The compressor compresses the He to about 100 psi, and the venturi completes the mixing with the recycled water. Increasing the He pressure from 0.5 to 100 psia with the compressor reduces the power necessary for venturi mixing from about 0.7 KW/Lbm·Hr to about 0.3 KW/Lbm·Hr He for a typical venturi mixer.

In addition, FIG. 10 shows two water pumps, 24A and 24B, used in series to increase water flow through the VHC.

The "catalytic" substance can be added to the working fluid over a wide range, for example, about 0.1 to 50% by weight. The closer the molecular weight of the working fluid to the "catalytic" substance, the greater the amount of "catalytic" substance that will be necessary. Where water is the working fluid, 3–9% by weight $H_2$ or He is preferred for addition.

Both hydrogen and helium increase the actual enthalpy of the working fluid, and increase the compressibility factor, increasing the expansion and enabling more mechanical work to be done. In addition, helium has been found to actually cool down the boiler, reducing fuel consumption and pollution.

The increase in enthalpy and compressibility factor are most dramatic when operating at the critical temperature and pressure of the working fluid, for water, 374° C. and 218 arm (3205 psi). While special containers are required for operation at such high pressures, such equipment is available and used, for example, with generation of power using nuclear reactors.

EXAMPLE 1

An apparatus was constructed according to FIG. 9. In practice, the boiler used was a commercially available apparatus, sold under the trademark BABY GIANT, Model BG-3.3 by The Electro Steam Generator Corporation of Alexandria, Va. and operating at about 70 psia. The boiler is heated by a stainless steel immersion heater consuming 3.3 kilowatts and developing an output of 10,015 BTUs per hour. The boiler as manufactured included temperature and pressure gauges located such that they would read the temperature and pressure in the boiler. Additional gauges were added to the system to read steam temperature and pressure, downstream in the collector. Valves were also added to the boiler allow gases to be added to the working fluid in the boiler. The temperature and pressure of the steam were measured in a 60 psi condenser coil which was added specifically to trap the steam.

The turbine was a 12 volt car alternator, having fins welded to it.

A 0.87 HP pump is used to pump water at about 38–45 lbs/min, and a venturi mixer is used with areas $A_1=0.0218$ ft$^2$ and $A_2=0.00545$ ft$^2$. Sufficient suction is created by the venturi mixer to mix He in the water feed line at a boiler pressure of about 81 psig, 97.5 psia.

Test runs were conducted with water alone as the working fluid, and with the addition of 5% by weight helium. After 90 minutes, the water only system had increased from 70° F. to about 375° F. and from 14.7 psi to about 68.0 psi. The system containing helium had increased from 70° F. to about 310° F., and from 14.7 psi to about 73.5 psi.

In addition, a voltmeter was connected to the alternator output. The reading for steam alone was 12 volts. For stear+He, the output was up to 18 volts.

Thus, it is clear that by adding a small amount of helium to the boiler, the resultant temperature after 90 minutes is relatively low, while the pressure obtained at the low temperature is relatively high. As a result of this higher pressure, more useful work can be done with the same amount of energy input.

EXAMPLE 2

An apparatus is constructed as shown in FIG. 8, with a 0.87 HP pump, and a 1 HP compressor. The use of the compressor enables helium at 20 psia to be returned to the boiler at 97.5 psia.

EXAMPLE 3

An apparatus is constructed as shown in FIG. 10, with a high pressure boiler operating at 900 psia. The use of a yenfurl having $A_1=0.0218$ ft$^2$ and $A_2=0.00545$ ft$^2$ is combined with existing 300 HP water pumps and 200 HP helium compressor.

What is claimed is:

1. In a process for converting heat energy to mechanical energy, comprising:

applying heat energy to a working fluid in a reservoir sufficient to convert the working fluid from liquid to vapor form;

passing the working fluid in vapor form to a means for converting energy therein to mechanical work, with expansion and reduction in temperature of the working fluid; and condensing expanded, temperature reduced working fluid from said means for converting to provide expanded temperature reduced working fluid in liquid form recycling the expanded, temperature reduced working fluid in liquid form to the reservoir;

the improvement comprising adding to the working fluid in the reservoir, a gas having a molecular weight no greater than the approximate molecular weight of the working fluid;

separating the gas from the working fluid external to the reservoir after the working fluid and gas have passed through said means for converting;

compressing the separated gas; and recycling the compressed, separated gas to the reservoir.

2. A process according to claim 1, wherein said compressing is performed mechanically.

3. A process according to claim 1, wherein said compressing is performed by restricting the flow of the liquid working fluid being recycled to the reservoir to create a source of suction, and directing the separated gas to the source of suction, thereby mixing the separated gas with the liquid working fluid and compressing the separated gas.

4. A process according to claim 3, wherein said compressing is performed initially mechanically, and subsequently by said restricting.

5. A process according to claim 1, additionally comprising purifying the separated gas prior to compressing.

6. A process according to claim 5, wherein said purifying is performed by pressure swing adsorption.

7. A process according to claim 1, wherein the working fluid is water.

8. A process according to claim 7, wherein the gas is selected from the group consisting of hydrogen and helium.

9. A process according to claim 1, wherein said adding comprises adding the gas to the working fluid in an amount of about 0.1–9% by weight.

10. A process according to claim 9, wherein said adding comprises adding the gas in an amount of about 3–9% by weight.

11. A process according to claim 1, wherein said passing comprises passing the working fluid to said means for converting at a temperature and pressure of about the critical temperature and pressure of the working fluid.

12. A process according to claim 11, wherein the working fluid is water heated in the reservoir to about 374° C.

13. An apparatus for converting heat energy to mechanical energy, comprising:

a) a reservoir for containing a working fluid;

b) a gas source in fluid connection with said reservoir;

c) means for heating the working fluid in said reservoir to vapor form;

d) means for expanding the working fluid in vapor form and converting a portion of the energy therein to mechanical work, in fluid connection with said reservoir;

e) means for cooling and condensing expanded working fluid in vapor form in fluid connection with said means for expanding;

f) means for returning cooled, condensed working fluid to the reservoir;

g) means for separating gas from cooled, condensed working fluid;

h) means for compressing the separated gas; and i) means for returning the compressed gas to said reservoir.

14. Apparatus according to claim 13, wherein said gas source contains a gas selected from the group consisting of hydrogen and helium.

15. Apparatus according to claim 13, wherein said means for compressing comprises a mechanical compressor.

16. Apparatus according to claim 13, wherein said means for compressing comprises a venturi mixer located in said means for returning working fluid, and which is connected to said means for separating gas, said venturi mixer creating suction for mixing separated gas with the working fluid.

17. Apparatus according to claim 16, additionally comprising a mechanical compressor disposed between said means for separating and said venturi mixing means, to provide an initial compression of the gas.

18. Apparatus according to claim 13, additionally comprising means for purifying the separated gas.

19. Apparatus according to claim 18, wherein said means for purifying comprises pressure swing adsorption means.

20. Apparatus according to claim 13, wherein said means for returning cooled, condensed working fluid comprises two pumps arranged in series.

* * * * *